US010273640B1

(12) United States Patent
Boston et al.

(10) Patent No.: US 10,273,640 B1
(45) Date of Patent: Apr. 30, 2019

(54) PAVING MACHINE WITH EMULSION SPRAY BAR

(71) Applicant: Caterpillar SARL, Geneva (CH)

(72) Inventors: Timothy Boston, Washington, IL (US); Andrea Fontana, Porto Tolle-Rovido (IT)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 15/975,923

(22) Filed: May 10, 2018

(51) Int. Cl.
*E01C 19/21* (2006.01)
*E01C 19/17* (2006.01)
*B05B 13/00* (2006.01)

(52) U.S. Cl.
CPC ..... *E01C 19/176* (2013.01); *E01C 19/21* (2013.01); *B05B 13/005* (2013.01); *E01C 2301/14* (2013.01)

(58) Field of Classification Search
CPC .... E01C 19/21; E01C 19/176; E01C 2301/14; B05B 13/005
USPC ..... 404/84.05, 111, 118
See application file for complete search history.

(56) References Cited

U.S. PATENT DOCUMENTS 5,324,136 A * 6/1994 Reymonet ..... E01C 19/48 404/107
5,549,457 A * 8/1996 Flores ..... E01C 19/176 404/111
5,735,634 A * 4/1998 Ulrich ..... E01C 19/48 404/102
5,957,621 A * 9/1999 Clark, Jr. ..... E01C 19/176 239/159
5,964,410 A * 10/1999 Brown ..... A01M 7/0014 137/513.3
7,118,047 B1 * 10/2006 James ..... E01C 19/172 239/129
7,488,138 B2 * 2/2009 Buschmann ..... E01C 19/176 239/161
8,061,931 B2 11/2011 Musil
8,696,238 B2 * 4/2014 Rogan ..... E01C 19/172 404/101
9,376,774 B2 * 6/2016 Menzenbach ..... B05B 1/3046
9,689,117 B2 6/2017 Bartoszek
9,845,579 B2 * 12/2017 Pembleton ..... E01C 7/00
2015/0337501 A1 * 11/2015 Thieme ..... E01C 11/24 404/75

FOREIGN PATENT DOCUMENTS

EP 0292337 B1 8/1990
JP 2007303189 A 11/2007
JP 04407967 B2 2/2010
JP 04721866 B2 7/2013

* cited by examiner

*Primary Examiner* — Raymond W Addie
(74) *Attorney, Agent, or Firm* — Bookoff McAndrews

(57) ABSTRACT

A paving machine includes a machine frame, a drive assembly, including at least two tracks, each driven by a drive wheel and one or more idlers, and a paving material delivery assembly including a hopper, a conveyor assembly, an auger, and a screed. The paving machine also includes a tank of emulsion fluid, a spray bar positioned on an underside of the machine frame between the at least two tracks and fluidly coupled to the tank to deliver the emulsion fluid to a ground surface.

20 Claims, 4 Drawing Sheets

PAVING MACHINE WITH EMULSION SPRAY BAR

TECHNICAL FIELD

The present disclosure relates generally to a road construction machine, and more particularly, to a paving machine with an emulsion spray bar.

BACKGROUND

The present invention relates to paving machines that are used in road surface construction and repairs. Paving machines are typically utilized to lay asphalt or other paving material. Paving often includes a tanker truck delivering a pre-coating tack, emulsion fluid, or other treatment fluid on the existing ground or road surface to aid in the bonding of the pavement. The paver machine then applies a new layer of pavement over the treatment fluid. However, the paver machine passes over the treatment fluid and leaves tracks in the treatment fluid, so the new pavement layer does not include a constant or uniform bonding to the existing ground or road surface. Passing over the treatment fluid may also be detrimental to the paver machine tracks.

U.S. Pat. No. 8,061,931, issued to Musil on Nov. 2, 2011 ("the '931 patent"), describes a pre-coating system and method for hot mix asphalt paving. The paving system uses an emulsion cart deployed ahead of a paver machine. The emulsion cart of the '931 patent is coupled to a forward spray bar on the paver machine that sprays an emulsion fluid on a ground surface located between the wheels of the paver machine to avoid the paver machine leaving tracks in the emulsion fluid. The forward spray bar is located at the front of the paver machine. The emulsion cart is also coupled to rear spray bars on the paver machine for spraying emulsion fluid on the ground surface behind the wheels of the paver machine. The emulsion cart of the '931 patent is a separate piece of machinery pushed ahead of the paver machine, rather than being built into the paver machine. Additionally, delivering emulsion fluid to the ground surface ahead of the paver machine may result in the emulsion fluid drying and/or changing temperature after the emulsion fluid has been delivered to the ground surface and before the paver machine delivers the paving material to the ground surface. The paving machine of the present disclosure may solve one or more of the problems set forth above and/or other problems in the art. The scope of the current disclosure, however, is defined by the attached claims, and not by the ability to solve any specific problem.

SUMMARY

In one aspect, a paving machine may include a machine frame, a drive assembly, including at least two tracks, each driven by a drive wheel and one or more idlers, and a paving material delivery assembly including a hopper, a conveyor assembly, an auger, and a screed. The paving machine also may include a tank of emulsion fluid and a spray bar positioned on an underside of the machine frame between the at least two tracks and fluidly coupled to the tank to deliver the emulsion fluid to a ground surface.

The paving machine may include any of the following aspects. The spray bar may be positioned between the drive wheel and a rearmost idler that drive each track in a direction of travel of the paving machine. The spray bar may be positioned beneath the conveyor assembly and between the auger and a front of the machine in a direction of travel. The spray bar may be positioned to the rear of a pivot location of the paving machine for turns. The at least two tracks may each include a top portion and a bottom portion, and the spray bar may be positioned at a height between the top portion and the bottom portion of each of the at least two tracks.

The spray bar may include a plurality of nozzles. The nozzles may include a spray portion including a cylindrical extension extending along a longitudinal axis of each nozzle, and the cylindrical extension may include an opening. The nozzles may include a coupling portion configured to be screwed into or welded to the spray bar. The nozzles may include a spray angle of approximately 110 degrees. The plurality of nozzles may be each coupled to a pneumatically controlled valve to control the delivery of the emulsion fluid through each nozzle. Each pneumatically controlled valve may be separately controllable via one or more user interfaces positioned on the machine frame. The spray bar may include a central channel in fluid communication with the tank, and the pneumatically controlled valves may control the rate of delivery of the emulsion fluid through each nozzle. The spray bar may include a common connector at one side of the spray bar to connect the spray bar to the tank and to a pneumatic fluid source. The paving machine may further include at least one side guard positioned between the spray bar and one of the tracks, and the at least one side guard may be configured to deflect emulsion fluid away from the tracks. The paving machine may include a plurality of side guards to form a rectangular shaped guard assembly that surrounds the spray bar. The paving machine may further include at least one protective guard positioned parallel to the spray bar and either in front of or behind the spray bar, and the at least one protective guard may be located at or below the spray bar.

In another aspect, a paving machine may include an operator station, a drive assembly, and a paving material delivery assembly. The paving material delivery assembly may include a hopper, a conveyor assembly, an auger, and a screed. The hopper may be positioned at a front of the paving machine, and the auger and the screed may be positioned at the rear of the paving machine. The conveyor assembly may connect the hopper to the auger. The paving machine may also include a tank containing emulsion fluid, and the tank of emulsion fluid may be positioned between the operator station and the hopper. The paving machine may also include a spray bar positioned on an underside of the paving machine and beneath a portion of the conveyor assembly, and the spray bar may be fluidly connected to the tank to deliver the emulsion fluid to a ground surface beneath the paving machine.

The paving machine may include any of the following aspects. The spray bar may include a plurality of controllable nozzles, and the spray bar may be at least partially surrounded by one or more guard elements. The drive assembly may include at least one rear drive wheel and at least one idler, and the spray bar may be coupled to the underside of the paving machine between the rear drive wheel and the rearmost idler.

In another aspect, an emulsion delivery assembly may include a supply of emulsion fluid and a spray bar fluidly coupled to the supply to deliver the emulsion fluid to a ground surface. The spray bar may include at least one nozzle and at least one pneumatic valve assembly positioned on the spray bar. The at least one nozzle may include an opening. The emulsion delivery assembly may also include a controller, and the controller may be operably coupled to the pneumatic valve to control the volume of emulsion fluid delivered through each nozzle.

The emulsion delivery assembly may include any of the following aspects. The spray bar may include a common connector at one side of the spray bar to connect the spray bar to the supply of emulsion fluid and to a pneumatic fluid source.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

For the purpose of this disclosure, the term "ground surface" is broadly used to refer to all types of surfaces that form typical roadways (e.g., asphalt, cement, clay, sand, dirt, etc.) or upon which paving material may be deposited in the formation of roadways. In this disclosure, relative terms, such as, for example, "about," "substantially," and "approximately" are used to indicate a possible variation of ±10% in a stated value. Although the current disclosure is described with reference to a paving machine, this is only exemplary. In general, the current disclosure can be applied as to any machine, such as, for example, a paver finisher, asphalt finisher, or another paving-type machine.

Figure 1:
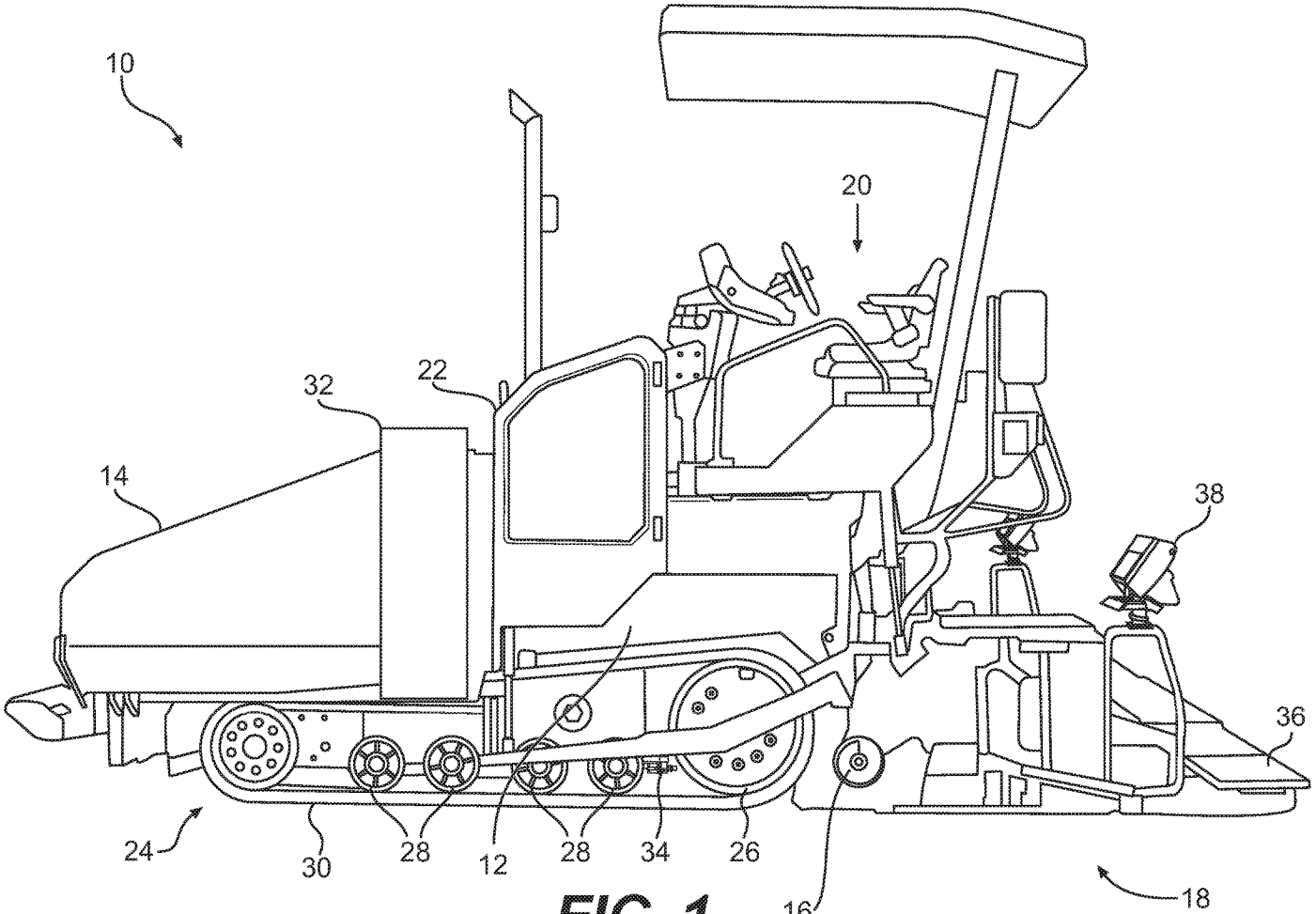
FIG. 1 is an illustration of one configuration of an exemplary machine, according to aspects of this disclosure.

FIG. 1 illustrates a side view of an exemplary paving machine 10, according to the present disclosure. Machine 10 may be a small paver, for example, with a maximum paving width of approximately 5.5 meters. Machine 10 includes a frame 12, a hopper 14, an auger 16, and a screed 18. Machine 10 may also include an operator station 20, from which an operator may maneuver and control machine 10. Machine 10 may be propelled by a engine assembly 22 to power a drive assembly 24, including a drive wheel 26, one or more idlers 28, and tracks 30. Additionally, machine 10 includes a tank 32 and a spray bar 34. Tank 32 may contain a treatment fluid or emulsion fluid, for example, a binding material, to be delivered to the ground surface by spray bar 34 prior to delivery of the paving material via auger 16 and screed 18.

Hopper 14 is positioned in a forward portion of frame 12 to receive or store the paving material, for example, from a mixer truck. Although not shown, a conveyor assembly connects hopper 14 to auger 16 in a rear portion of frame 12 to convey the paving material. The conveyor assembly may extend beneath tank 30, engine assembly 22, and operator station 20, and may be positioned above spray bar 34.

Figure 4:
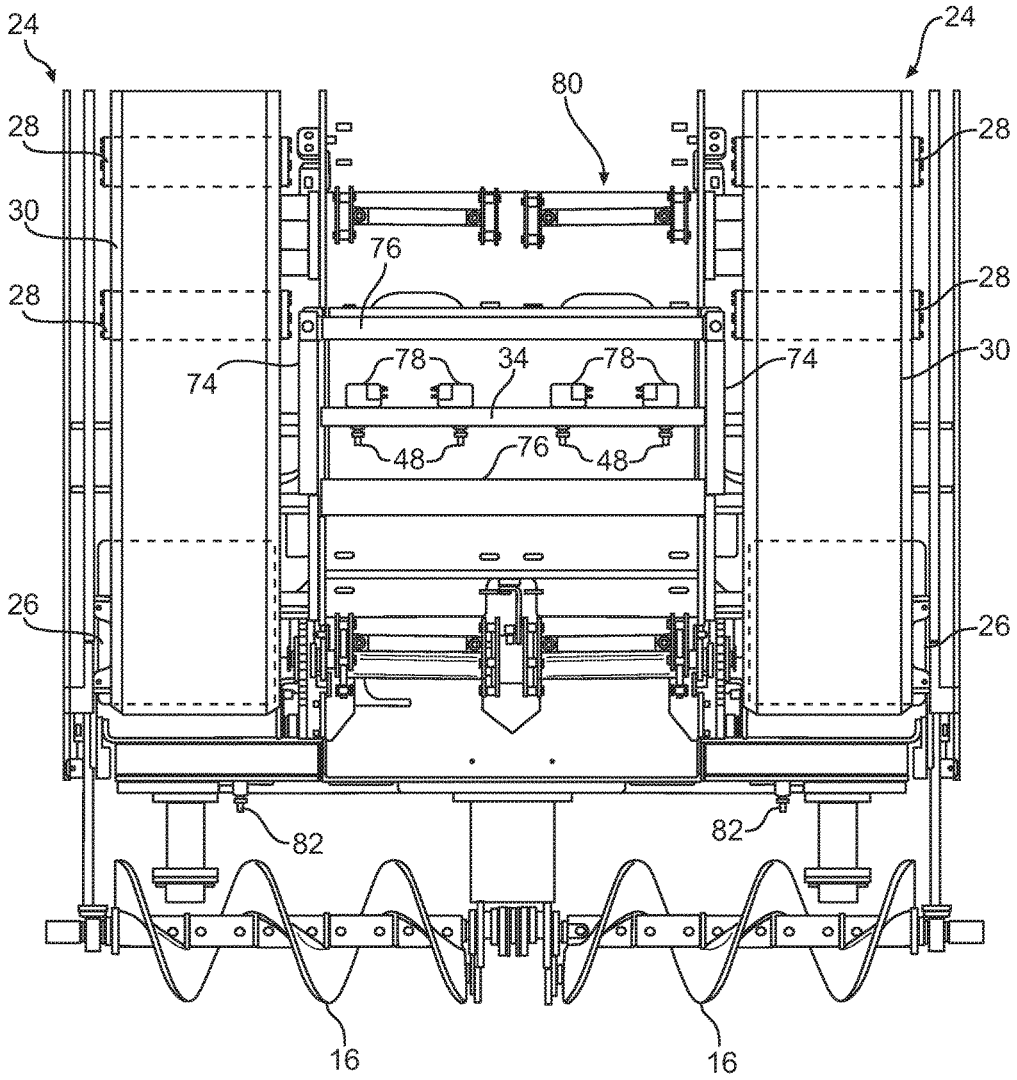
FIG. 4 is a bottom view of a portion of the machine of FIG. 1, according to aspects of this disclosure.

Auger 16 may be positioned perpendicular to the direction of travel of machine 10. Additionally, auger 16 may include a plurality of parallel or longitudinally arranged augers (FIG. 4). Screed 18 is positioned to the rear of auger 16, and smooths the paving material delivered by auger 16 to the paving surface. Screed 18 may further include one or more operator positions 36 on which an operator may stand, and operator positions 36 may include a monitor or control element 38. The height of screed 18 may be adjustable, for example, via control element 38. Operator station 20 may include a plurality of user interfaces similar to control element 38 in order for an operator to steer machine 10, control a rate of delivery of the paving material, adjust the height of screed 18, control the delivery of emulsion fluid via spray bar 34, etc.

As shown in FIG. 1, spray bar 34 may be positioned between drive wheel 26 and one of idlers 28, for example, a rearmost idler 28, relative to the longitudinal direction or direction of travel of machine 10 Spray bar 34 may be mounted to an underside of machine 10, and may be positioned at a height above the upper edge of the bottom portion of track 30. Spray bar 34 may be removably mounted to the underside of machine 10 such that spray bar 34 may be accessed and/or uncoupled from machine 10 through the space between drive wheel 26 and the rearmost idler 28. Spray bar 34 may extend a width of machine 10 between the drive wheel 26, idlers 28, and tracks 30 (FIG. 4). Moreover, although not shown, machine 10 may include one or more additional spray bars positioned to the rear of machine 10, for example, to spray the ground surface to the rear of tracks 30. Spray bar 34 and the additional spray bars may be fluidly coupled to tank 32.

Figure 2:
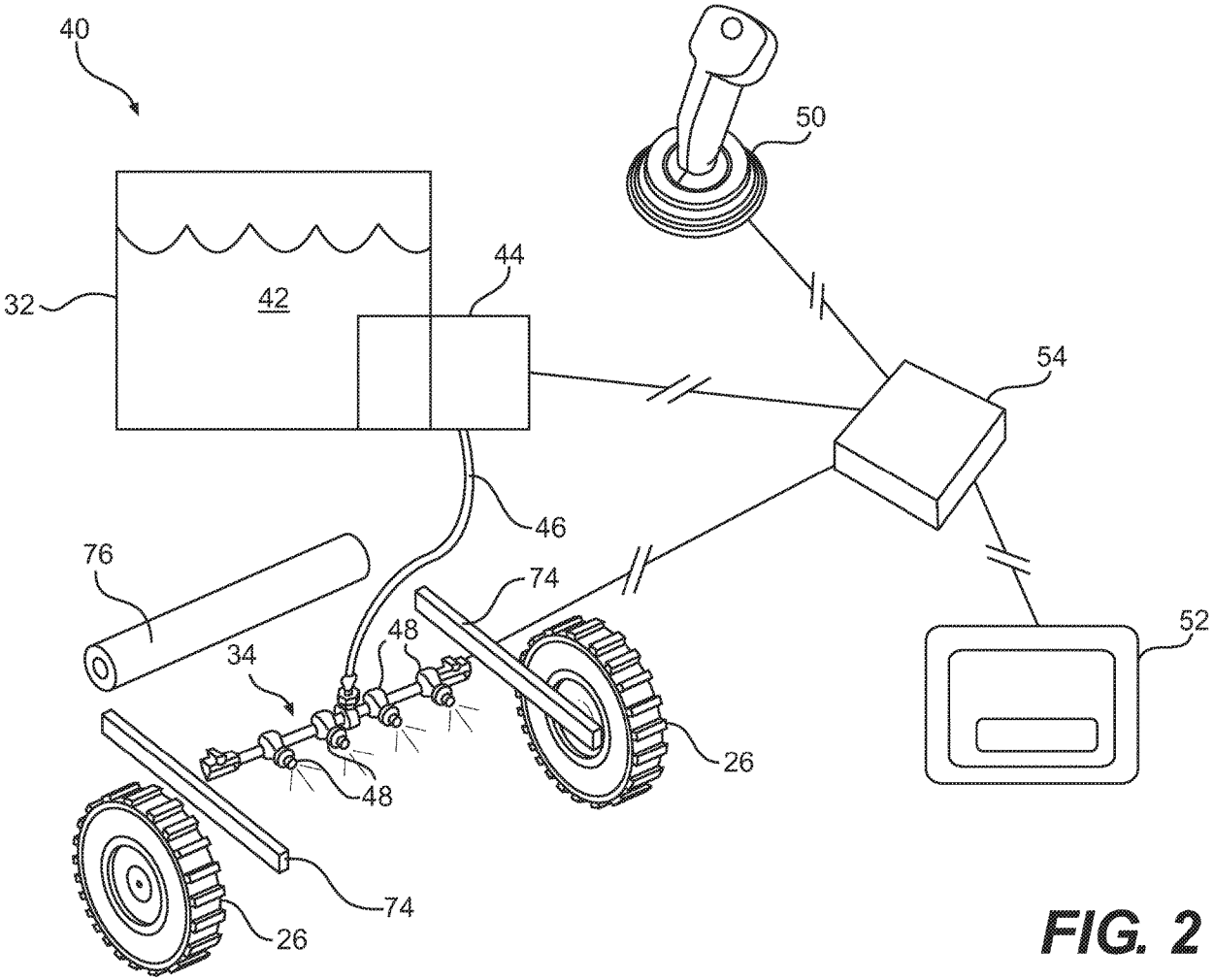
FIG. 2 is a schematic, exploded view of a portion of the exemplary machine of FIG. 1, according to aspects of this disclosure.

FIG. 2 illustrates an exploded view of a portion of machine 10. Specifically, FIG. 2 shows an emulsion system 40 to control and deliver emulsion fluid 42 to spray bar 34, with spray bar 34 positioned between and in front of drive wheels 26. Emulsion system 40 includes a supply of emulsion fluid 42 stored in a container, for example, tank 32. System 40 also includes a pump 44, which may be integral with tank 32 or may be separately positioned within machine 10. Tank 32 and pump 44 are connected to spray bar 34 by one or more hoses 46, and spray bar 34 includes one or nozzles 48 to direct emulsion fluid 42 toward the ground surface. Although not shown, emulsion system 40 may include one or more emulsion filters to filter or clean emulsion fluid 42 from tank 32 before being delivered by nozzles 48. Nozzles 48 may be spaced, evenly or unevenly, along a width of spray bar 34 and positioned on a bottom or side portion of spray bar 34. Nozzles 48 may be in fixed positions. The fixed positions of nozzles 48 may position nozzles 48 in an angled configuration, for example directed toward the front or rear of machine 10, or the fixed positions of nozzles 48 may direct nozzles 48 downward toward the ground surface. As discussed in greater detail below with respect to FIG. 3, machine 10 may include one or more side guards 74 positioned between transverse to spray bar 34 and between spray bar 34 and drive wheels 26 to help direct emulsion fluid 42 toward the ground surface and not onto drive wheels 26. Machine 10 may also include one or more protective guards 76 positioned parallel to spray bar 34, which may help protect spray bar 34 from debris.

Emulsion system 40 may further include an input device 50, a display 52, and a controller 54. Input device 50, display 52, and controller 54 may be wired or wirelessly connected to each other and to pump 44. Input device 50 may be operable to control the delivery of emulsion fluid 42 by opening or closing one or more internal valves and/or by controlling the operation of pump 44. Alternatively or additionally, input device 50 may be operably coupled to spray bar 34 and/or nozzles 48 to selectively control the volume of emulsion fluid 42 delivered to the ground surface by each nozzle 48. Display 52 may indicate a volume of emulsion fluid 42 in tank 32. Display 52 may also indicate a status of emulsion system 40, e.g., on or off, a rate of delivery of emulsion fluid 42, an angle of nozzles 48, a steering angle of machine 10, etc. Alternatively, input device 50 and display 52 may be combined into a touch screen user interface. Controller 54 may include a computer or computer readable memory storing computer executable instructions to control activation of emulsion system 40. Additionally, controller 54 may be configured to receive data from one or more sensors, for example, temperature and volume sensors in tank 32, temperature and volume sensors on spray bar 34, or other sensors to detect or estimate the coverage of emulsion fluid 42 sprayed from spray bar 34 on the ground surface. Controller 54 may also be configured to receive user commands from input device 50 or sensor data and selectively control the volume of emulsion fluid 42 through each nozzle 48, for example, by pivoting each nozzle 48, either parallel to or transverse to the direction of travel of machine 10, and/or opening or closing one or more internal valves.

Figure 3B:
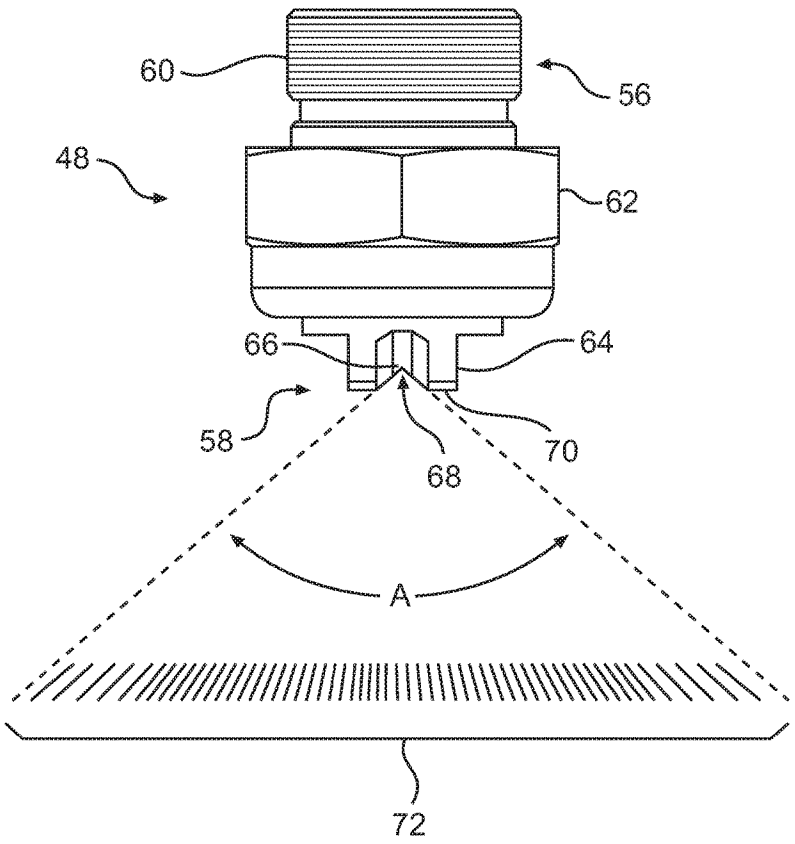
FIG. 3B is a schematic end view of the exemplary nozzle, according to aspects of this disclosure.
Figure 3A:
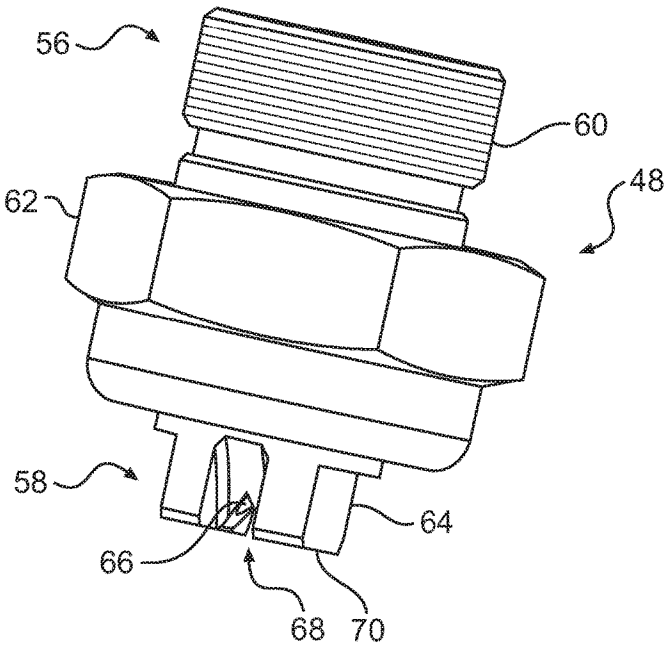
FIG. 3A is a perspective view of an exemplary nozzle.

FIGS. 3A and 3B illustrate aspects of a nozzle 48 that may be coupled to spray bar 34 to direct emulsion fluid 42. Nozzle 48 may include a coupling portion 56 and a spray portion 58. Coupling portion 56 may include threading 60, and a gripping portion 62. Threading 60 may be screwed into a threaded hole in spray bar 34. Alternatively, coupling portion 56 may be welded or otherwise coupled to spray bar 34. Gripping portion 62 may be, for example, rectangular, hexagonal (as shown), octagonal, or another appropriate shape to allow for gripping. Spray portion 58 may include a cylindrical extension 64 with a central passage 66 that is fluidly connected to an internal lumen of spray bar 34 when nozzle 48 is connected to spray bar 34. Cylindrical extension 64 may include an opening 68 and an end face 70. With nozzle 48 coupled to spray bar 34, nozzle 48, and thus opening 68, may be facing downward toward the ground surface. In another aspect, opening 68 may be a cutout extending at an angle relative to nozzle 48. For example, opening 68 may extend at an angle of approximately 45 degrees relative to a longitudinal axis L of nozzle 48, and may extend approximately half of the width of cylindrical extension 64. In this non-illustrated example, nozzle 48 may be coupled to spray bar 34 with cylindrical extension 64 extending substantially parallel to the ground surface, with opening 68 facing the ground surface.

As shown in FIG. 3B, which is a side view of nozzle 48, opening 68 may create a spray zone 72 when emulsion fluid 42 is pumped to spray bar 34 and out of nozzle 48. Spray zone 72 may include an angular range A of approximately 45, 60, 75, 90, 105, 110, 120, or 135 degrees. The spray zone 72 of nozzle 48 may correspond to a height of spray bar 34 from the ground surface, the spacing of nozzles 48 on spray bar 34, etc. in order for the entirety of the ground surface to be sufficiently coated with emulsion fluid 42.

FIG. 4 illustrates a bottom view of a portion of machine 10. As discussed, spray bar 34 may be positioned longitudinally between drive wheel 26 and one of idlers 28 along the length of machine 10. Spray bar 34 may have a width approximately equal to the width between tracks 30. Spray bar 34 may be coupled to machine 10 such that a bottom edge of spray bar 34 facing the ground surface is above the maximum height of the portion of track 30 that is in contact with the ground surface (i.e., a bottom portion), as shown in FIG. 1. Spray bar 34 may be coupled to the underside of machine 10 via one or more bolts, threaded elements, clips, etc. In one aspect, spray bar 34 may be secured to the underside of machine 10 via one bolt or clip on each side of spray bar 34 (FIG. 2), with the bolts or clips being accessible to the user via the space between drive wheel 26 and idler 28. For example, spray bar 34 may extend to the sides of machine 10 such that the connections to machine 10 may be formed by spray bar 34 being coupled to the portions of frame 12 positioned between top and bottom portions of tracks 30, which may the user to access spray bar 34 in the space between top and bottom portions of tracks 30.

Machine 10 may also include side guards 74. Side guards 74 may be positioned parallel to drive assembly 24 in the direction of travel and between drive assembly 24 and nozzles 48 on spray bar 34. Side guards 74 may be coupled to an underside of machine 10 and extend downward toward the ground surface. For example, side guards 74 may extend downward in a direction normal to the ground surface. Side guards 74 may extend to a position below spray bar 34. As such, side guards 74 may help prevent or reduce the amount of emulsion fluid emitted by spray bar 34 that contacts the elements of drive assembly 24. Side guards 74 may also help to direct the emulsion fluid from nozzles 48 toward the middle of machine 10, such that tracks 30 do not pass over and affect the emulsion fluid delivered by spray bar 34. Although not shown, a plurality of side guards 74, for example, four side guards 74, may form a rectangular shaped guard assembly that may surround spray bar 34 on both sides as well as in front and behind spray bar 34 to help to ensure that the emulsion fluid is delivered to the ground surface and does not contact elements of drive assembly 24. Side guards 74, either as shown or as discussed to form the rectangular shaped guard assembly, may be mounted to an underside of machine 10 or may be directly coupled to spray bar 34. In one aspect, side guards 74 may be made of a rubber or plastic material.

Machine 10 may also include one or more protective guards 76. Protective guards 76 may be positioned in front of and/or behind nozzles 48 on spray bar 34, and may be perpendicular to drive assembly 24 and the direction of travel. Protective guards 76 may, for example, be a rod, bar, or tube having a circular, tubular, or rectangular cross-section coupled to the bottom portion of machine 10. Protective guards 76 may be positioned at approximately the same height from the ground surface as spray bar 34, and may be approximately as wide as spray bar 34 or as wide as the portion of spray bar 3 that includes nozzles 48. Alternatively, protective guards 76 may be solid elements that extend continuously from the bottom portion of machine 10 to the height from the ground surface of spray bar 34, or closer to the ground surface. Protective guards 76 may help to prevent damage to spray bar 34, nozzles 48, and other elements of machine 10 by reducing the likelihood of rocks, dirt, and other elements on the ground surface from impacting or otherwise affecting spray bar 34, nozzles 48, etc. In one aspect, protective guards 76 may be made of steel, iron, or another appropriate material.

Additionally, as illustrated in FIG. 4, machine 10 may include a plurality of spray controllers 78 coupled to spray bar 34 and nozzles 48 to operably control each nozzle 48. For example, spray controllers 78 may include pneumatic valves that may be adjustable via a user interface in operator station 20 or operator position 36 (e.g., one or more of control element 38, input device 50, display 52, and controller 54) such that the user may adjust and control the flow rate of emulsion fluid 42 through each nozzle 48. Although not shown, machine 10 may include electrical connections and tubes or hoses coupling spray controllers 78 to a pneumatic fluid source. The electrical connections and hoses may include a slack distance to allow for the hoses to remain secured even if spray bar 34 is uncoupled from machine 10 or otherwise adjusted, and/or may include quick-couplings for easy decoupling.

In one aspect, spray bar 34 may include a central channel that carries emulsion fluid 42, and spray controllers 78 may control the flow of emulsion fluid 42 from the central channel through each individual nozzle 48. As such, a user may selectively control the flow of emulsion fluid 42 through each nozzle 48, and thus control the spray pattern emitted from spray bar 34.

FIG. 4 also illustrates a portion of conveyor assembly 80 that delivers paving material from hopper 14 toward auger 16. As shown, conveyor assembly 80 may pass above and not interact with spray bar 34, nozzles 48, side guards 74, and protective guards 76. Furthermore, machine 10 may include rear spray elements 82 positioned to the rear of tracks 30 and the other elements of drive assembly 24. Although not shown, rear spray elements 82 may include nozzles and/or spray controllers similar to as discussed above with respect to spray bar 34. Rear spray elements 82 may be fluidly connected to tank 32 in order to deliver emulsion fluid 42 to the ground surface at the rear of drive assembly 24 in front of auger 16. Because rear spray elements 82 are positioned to the rear of drive assembly 24, emulsion fluid 42 delivered by rear spray elements 82 will not be run over or otherwise interfered with by tracks 30. Screed 18 is positioned to the rear of auger 16, as shown in FIG. 1, to spread and smooth the delivered paving material.

INDUSTRIAL APPLICABILITY

The disclosed aspects of machine 10 may be used in any paving machine to assist in delivery of paving material. During operation, spray bar 34 may deliver emulsion fluid 42 to the ground surface traversed by machine 10. The position of spray bar 34 may help to allow for the delivery of emulsion fluid 42 to coat the ground surface before the paving material is delivered, and thus help to promote binding of the paving material with the ground surface. For example, spray bar 34 may be positioned between drive wheel 26 and one or more idlers 28. As such, spray bar 34 may deliver emulsion fluid 42 to the ground surface in proximity to auger 16 and screed 18, which may help to ensure that the density, consistency, temperature, and other properties of the delivered emulsion fluid 42 do not substantially change between the delivery from spray bar 34 and the time emulsion fluid 42 is covered with paving material. Additionally, the proximity of spray bar 34 to auger 16 and screed 18 may help to limit the amount of foreign material (e.g., dust, rocks, etc.) that may contact or mix with emulsion fluid 42 to potentially impair the binding of the paving material to the ground surface.

The position of spray bar 34 may also help to ensure that tracks 30 do not pass through the delivered emulsion fluid 42. If the tracks 30 pass through the delivered emulsion fluid 42, the binding of the paving material to the ground surface may be impaired. Additionally, if the emulsion fluid 42 coats the tracks 30 or other elements of drive assembly 24, those elements may become dirty, may unduly attract or bond with foreign material or the paving material, or may otherwise require further cleaning or maintenance. Spray bar 34 spans the width between tracks 30, and nozzles 48 direct emulsion fluid 42 substantially downward in the area between tracks 30. As such, spray bar 34 may help to prevent emulsion fluid 42 from being sprayed onto drive wheel 26, idlers 28, tracks 30, or any other portion of drive assembly 24. The inclusion of side guards 74 may further help to prevent emulsion fluid 42 from being sprayed onto or otherwise interacting with the elements of drive assembly 24.

As shown in FIG. 1, spray bar 34 may be positioned to the rear of idlers 28, and a rearmost idler 28 may define a pivot or turning point for machine 10 during turns. Therefore, spray bar 34 may be located to the rear of the pivot or turning point, so the emulsion fluid 42 sprayed by nozzles 48 on spray bar 34 on the ground surface will likely not be traversed or otherwise interfered with by tracks 30, even while machine 10 makes turns. The position of spray bar 34 may also help to ensure that emulsion fluid 42 is delivered to the ground surface and does not mix with the paving material until the paving material is delivered by auger 16. Moreover, the position of spray bar 34 in proximity to auger 16 and screed 18 may help to ensure that the density, consistency, temperature, and other properties of emulsion fluid 42 delivered to the ground surface do not substantially change between the delivery and the time emulsion fluid 42 is covered with paving material.

Additionally, the location and mounting of spray bar 34 may help to allow access in order to inspect, clean, repair, or replace spray bar 34. For example, a user may access the connections, for example, one or more screws and bolts, clips, or other mountings, between spray bar 34 and machine 10 through the space between drive wheel 26 and one of idlers 28. A user may disconnect spray bar 34 from one or more mountings accessible through the space between drive wheel 26 and a rearmost idler 28, and between the upper and lower portions of track 30, in order to inspect, clean, repair, or replace spray bar 34. The electric and hydraulic connections to spray controllers 78 and/or hoses 46 connected to tank 32 may include slack amounts that allow spray bar 34 to extend away from machine 10 for a slack distance for the user to evaluate spray bar 34. Alternatively or additionally, the hydraulic connections and/or hoses 46 may include one or more common attachments to spray bar 34, for example, at one end of spray bar 34, such that the connections and hoses 46 may be disconnected from spray bar 34, and spray bar 34 may be removed from machine 10.

It will be apparent to those skilled in the art that various modifications and variations can be made to the disclosed machine without departing from the scope of the disclosure. Other embodiments of the machine will be apparent to those skilled in the art from consideration of the specification and practice of the paving machine with emulsion spray bar disclosed herein. It is intended that the specification and examples be considered as exemplary only, with a true scope of the disclosure being indicated by the following claims and their equivalents.

What is claimed is:

1. A paving machine, comprising a machine frame;

a drive assembly, including at least two tracks, each driven by a drive wheel and one or more idlers;

a paving material delivery assembly including a hopper, a conveyor assembly, an auger, and a screed;

a tank of emulsion fluid; and a spray bar positioned on an underside of the machine frame between the at least two tracks and between the drive wheel and a rearmost idler of each track, wherein the spray bar is fluidly coupled to the tank to deliver the emulsion fluid to a ground surface.

2. The paving machine of claim 1, wherein the drive wheel and the rearmost idler of each track drive each track in a direction of travel of the paving machine.

3. The paving machine of claim 2, wherein the paving machine includes a longitudinal line extending from a front of the paving machine to a rear of the paving machine and defining a longitudinal direction, and wherein the spray bar is positioned beneath the conveyor assembly and between the auger and the front of the paving machine in the longitudinal direction.

4. The paving machine of claim 3, wherein the spray bar is positioned to the rear of a pivot location of the paving machine for turns.

5. The paving machine of claim 4, wherein the at least two tracks each include a top portion and a bottom portion, and wherein the spray bar is positioned at a height between the top portion and the bottom portion of each of the at least two tracks.

6. The paving machine of claim 1, wherein the spray bar includes a plurality of nozzles.

7. The paving machine of claim 6, wherein the nozzles include a spray portion including a cylindrical extension extending along a longitudinal axis of each nozzle, wherein the cylindrical extension includes an opening, and wherein the nozzles include a coupling portion configured to be screwed into or welded to the spray bar.

8. The paving machine of claim 6, wherein the nozzles include a spray angle of approximately 110 degrees.

9. The paving machine of claim 6, wherein the plurality of nozzles are each coupled to a pneumatically controlled valve to control the delivery of the emulsion fluid through each nozzle.

10. The paving machine of claim 9, wherein each pneumatically controlled valve is separately controllable via one or more user interfaces positioned on the machine frame.

11. The paving machine of claim 10, wherein the spray bar includes a central channel in fluid communication with the tank, and wherein the pneumatically controlled valves control the rate of delivery of the emulsion fluid through each nozzle.

12. The paving machine of claim 11, wherein the spray bar includes a common connector at one side of the spray bar to connect the spray bar to the tank and to a pneumatic fluid source.

13. The paving machine of claim 1, further including at least one side guard positioned between the spray bar and one of the tracks, wherein the at least one side guard is configured to deflect emulsion fluid away from the tracks.

14. The paving machine of claim 13, wherein the paving machine includes a plurality of side guards to form a rectangular shaped guard assembly that surrounds the spray bar.

15. The paving machine of claim 1, further including at least one protective guard positioned parallel to the spray bar and either in front of or behind the spray bar, wherein the at least one protective guard is located at or below the spray bar.

16. A paving machine, comprising:

an operator station;

a drive assembly including two tracks;

a paving material delivery assembly, including a hopper, a conveyor assembly, an auger, and a screed, wherein the hopper is positioned at a front of the paving machine, wherein the auger and the screed are positioned at the rear of the paving machine, and wherein the conveyor assembly connects the hopper to the auger;

a tank containing emulsion fluid, wherein the tank of emulsion fluid is positioned between the operator station and the hopper; and a spray bar positioned on an underside of the paving machine at a position beneath a portion of the conveyor assembly and between the two tracks, wherein the spray bar is fluidly connected to the tank to deliver the emulsion fluid to a ground surface beneath the paving machine.

17. The paving machine of claim 16, wherein the spray bar includes a plurality of controllable nozzles, and wherein the spray bar is at least partially surrounded by one or more guard elements.

18. The paving machine of claim 16, wherein the drive assembly includes at least one rear drive wheel and at least one idler, and wherein the spray bar is coupled to the underside of the paving machine between the rear drive wheel and a rearmost idler.

19. An emulsion delivery assembly for a machine, the emulsion delivery assembly comprising:

a supply of emulsion fluid;

a spray bar fluidly coupled to the supply to deliver the emulsion fluid to a ground surface, wherein the spray bar includes at least one nozzle and at least one pneumatic valve assembly positioned on the spray bar, and wherein the at least one nozzle includes an opening; and a controller, wherein the controller is operably coupled to the pneumatic valve to control the volume of emulsion fluid delivered through each nozzle, wherein the machine is driven in a direction of travel by at least two tracks on respective sides of the machine, wherein the tracks extend a track length along the machine in the direction of travel, and wherein the spray bar is configured to be coupled to a bottom portion of the machine at a position between the tracks and along the track length.

20. The emulsion delivery assembly of claim 19, wherein the spray bar includes a common connector at one side of the spray bar to connect the spray bar to the supply of emulsion fluid and to a pneumatic fluid source, and wherein the emulsion delivery assembly further includes two side guards positioned perpendicular to the spray bar.

* * * * *